US007395744B2

(12) United States Patent
Connor

(10) Patent No.: US 7,395,744 B2
(45) Date of Patent: Jul. 8, 2008

(54) CHAD DIVERTING APPARATUS

(75) Inventor: Eric J. Connor, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 402 days.

(21) Appl. No.: 10/858,171

(22) Filed: Jun. 1, 2004

(65) Prior Publication Data

US 2005/0262986 A1 Dec. 1, 2005

(51) Int. Cl.
*B26D 7/06* (2006.01)
*B07C 5/16* (2006.01)

(52) U.S. Cl. ..... 83/106; 83/167; 209/592; 209/645

(58) Field of Classification Search ..... 83/104–106, 83/102, 105, 106 X, 109, 159, 160, 161, 167 X, 83/149, 150, 27, 157, 167; 209/592 X, 650, 209/645 X, 592, 645; 414/934
See application file for complete search history.

(56) References Cited

U.S. PATENT DOCUMENTS

| | | | | | |
|---|---|---|---|---|---|
| 3,169,428 | A * | 2/1965 | Owen | 83/27 |
| 3,180,190 | A * | 4/1965 | Haselow | 83/106 |
| 3,631,979 | A * | 1/1972 | Frankiewicz et al. | 83/105 |
| 3,728,920 | A | 4/1973 | Gardner et al. | |
| 3,830,144 | A * | 8/1974 | Kuckhermann et al. | 414/934 |
| 3,880,033 | A * | 4/1975 | Taylor | 83/104 |
| 3,984,094 | A * | 10/1976 | Stocker | 271/303 |
| 4,013,357 | A | 3/1977 | Nakajima et al. | |
| 4,099,434 | A * | 7/1978 | Hardouin | 83/157 |
| 4,156,376 | A * | 5/1979 | Benuzzi | 83/157 |
| 4,176,535 | A | 12/1979 | Elsner et al. | |
| 4,207,787 | A * | 6/1980 | Lewallyn | 83/157 |
| 4,235,434 | A * | 11/1980 | Müller | 271/305 |
| 4,445,409 | A | 5/1984 | Mohr et al. | |
| 4,804,078 | A * | 2/1989 | Scata' | 209/655 |
| 5,408,254 | A * | 4/1995 | Stapleton | 346/136 |
| 5,438,435 | A * | 8/1995 | Lawniczak | 271/9.09 |
| 5,447,303 | A * | 9/1995 | Smith | 271/65 |
| 5,459,493 | A * | 10/1995 | Johnson | 346/136 |
| 5,732,609 | A * | 3/1998 | Marschke | 83/167 |
| 5,857,370 | A | 1/1999 | Grenz et al. | |
| 6,474,885 | B2 | 11/2002 | Kuzniarek et al. | |
| 6,554,123 | B2 * | 4/2003 | Bonnet | 209/592 |
| 6,603,954 | B1 * | 8/2003 | Zoltner et al. | 83/109 |
| 6,651,821 | B2 * | 11/2003 | Ratesic | 209/592 |

FOREIGN PATENT DOCUMENTS

| | | | |
|---|---|---|---|
| EP | 0 448 512 B1 | | 3/1991 |
| EP | 0 722 114 A3 | | 12/1995 |
| GB | 779589 | * | 7/1957 |
| JP | 2-116503 | | 5/1990 |
| JP | 2000-15879 | | 1/2000 |
| JP | 2001-105677 | | 4/2001 |

* cited by examiner

*Primary Examiner*—Jason Prone
(74) *Attorney, Agent, or Firm*—Mark G. Bocchetti

(57) ABSTRACT

An apparatus for diverting chad in a paper printer including a paper supply, a cutting mechanism for cutting the paper perpendicular to the path of the paper and a diverter flap positioned downstream of the cutting mechanism, the diverter flap being biased to reside in a first position defining a first path for chad to travel to be delivered into a receptacle, the diverter flap moving to a second position when a cut sheet falls thereon thereby allowing the cut sheet to travel a second path into a receiving tray.

8 Claims, 4 Drawing Sheets

CHAD DIVERTING APPARATUS

FIELD OF THE INVENTION

This invention relates generally to printing systems in which images and text are printed onto paper, and, more specifically, to printers which require the paper to be cut to size or trimmed within the printer. In particular, this invention relates to an apparatus for directing trimmed waste away from a print path.

BACKGROUND OF THE INVENTION

There are many printing systems that use cutting mechanisms to trim the paper either before or after printing. One example is the Kodak Photo Printer 4720 sublimation dye thermal printer. In that printer, a cutting mechanism is used to trim non-printed areas (chad) from a pre-cut sheet. Another example is the Kodak Photo Printer 6400 sublimation dye thermal printer. In that printer, a cutting mechanism is used to trim each final print. The non-printed area is cut off while the printed area is still attached to the remaining roll of paper supply. Then the final print is cut from the roll. In any case, it is desirable to collect the chad in a receptacle within the printer for later removal. It is also desirable to avoid a build up of chad from interfering with the printing process. Therefore, there exists a need to direct the chad away from the print path towards a receptacle.

One approach is described in U.S. Pat. No. 6,474,885. In that device, the chad is allowed to fall onto a tray cover while the print is directed towards the exit of the printer by a set of rollers. A roller built into the tray cover moves the chad along towards the collection area and avoids a buildup of chad from blocking the print path. Another approach to waste removal (U.S. Pat. No. 4,445,409) simply allows the waste to fall through an opening that is bigger than the waste but smaller than the work piece. However, this arrangement requires some mechanism to move the work piece after the cutting operation has been performed.

Yet another approach is described in U.S. Pat. No. 3,728,920. In that apparatus described therein, a diverting system is taught in which a controller energizes a deflector system to direct waste towards a receptacle and printed documents toward an exit.

SUMMARY OF THE INVENTION

It is a feature and advantage of the present invention to provide an apparatus for separating chad from cut sheets that does not require a sensing system or a separate drive mechanism to move or direct either the chad or the cut sheet to its desired location after cutting. The present invention provides a device within a printing system for directing chad in a first direction along a first path and cut sheets in a second direction along a second path. The first path allows the chad to accumulate at a location where they will not interfere with the operation of the printer. After the cutting/trimming operation, each cut sheet is trimmed appropriately and delivered to a second location via the second path free of chad.

According to a feature of the present invention, a separating device includes a diverter flap that may be biased by gravity or spring load to normally reside in a first position. This diverter flap is located just below a cutting mechanism. This cutting mechanism cuts the paper perpendicular to the feed direction of the paper, and is used to trim small strips of waste or chad from the final prints. Paper is delivered from a paper supply to the cutting mechanism, with any number of printing or processing steps in between. With the flap residing in the first position, a chad falling from the cutting mechanism will travel along a defined first path. Since the chad is very light compared to the delivered print, the magnitude of the bias on the flap can be set such that the weight of chad falling upon it does not overcome the biasing means, thereby insuring that the path of travel of a falling chad will be along this first path. A removable receptacle may reside within the printer housing positioned to receive chad falling along the first path.

The biasing means may be overcome such that the diverter flap can be moved to reside in a second position thereby defining a second path. The diverter flap moves to this second position when a cut sheet falls thereon. The weight of a cut sheet/final print is relatively heavy as compared to the weight of an individual piece of chad. By setting the force applied by the biasing means such that the weight of a piece of chad will not overcome that force, a falling piece of chad hitting the diverter flap will not result in moving the diverter flap to the second position and the piece of chad will be directed along the first path. A cut sheet/final print contacting the diverter flap will have sufficient weight to overcome the force of the biasing means to thereby move the diverter flap to the second position. As the flap moves to the second position, the cut sheet/final print travels along a second path. A receiving tray may reside at the end of the second path to catch sheets falling along the second path.

BRIEF DESCRIPTION OF THE DRAWINGS

In the detailed description of the invention presented below, reference is made to the accompanying drawings, in which.

DETAILED DESCRIPTION OF THE INVENTION

While specific embodiments of the present invention are discussed in detail below, it should be appreciated that the present invention provides many applicable, inventive concepts that can be embodied in a wide variety of specific contexts. These specific embodiments discussed herein are merely illustrative of specific ways to make and use the invention, and do not delimit the scope or application of the invention.

Figure 1:
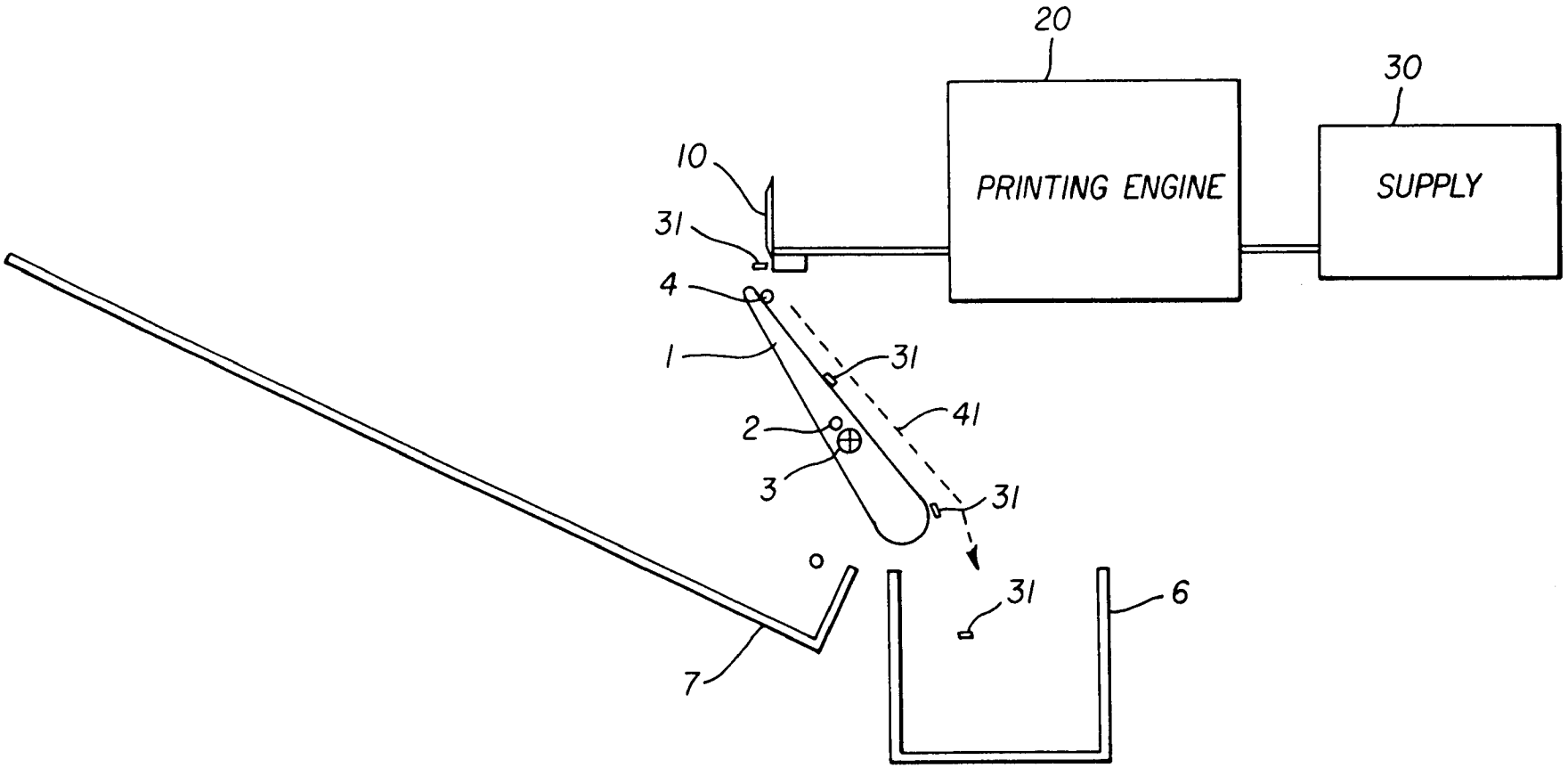
FIG. 1 is a side view elevational schematic of the apparatus of the present invention illustrating the path taken by a piece of chad in a preferred embodiment of the present invention.
Figure 2:
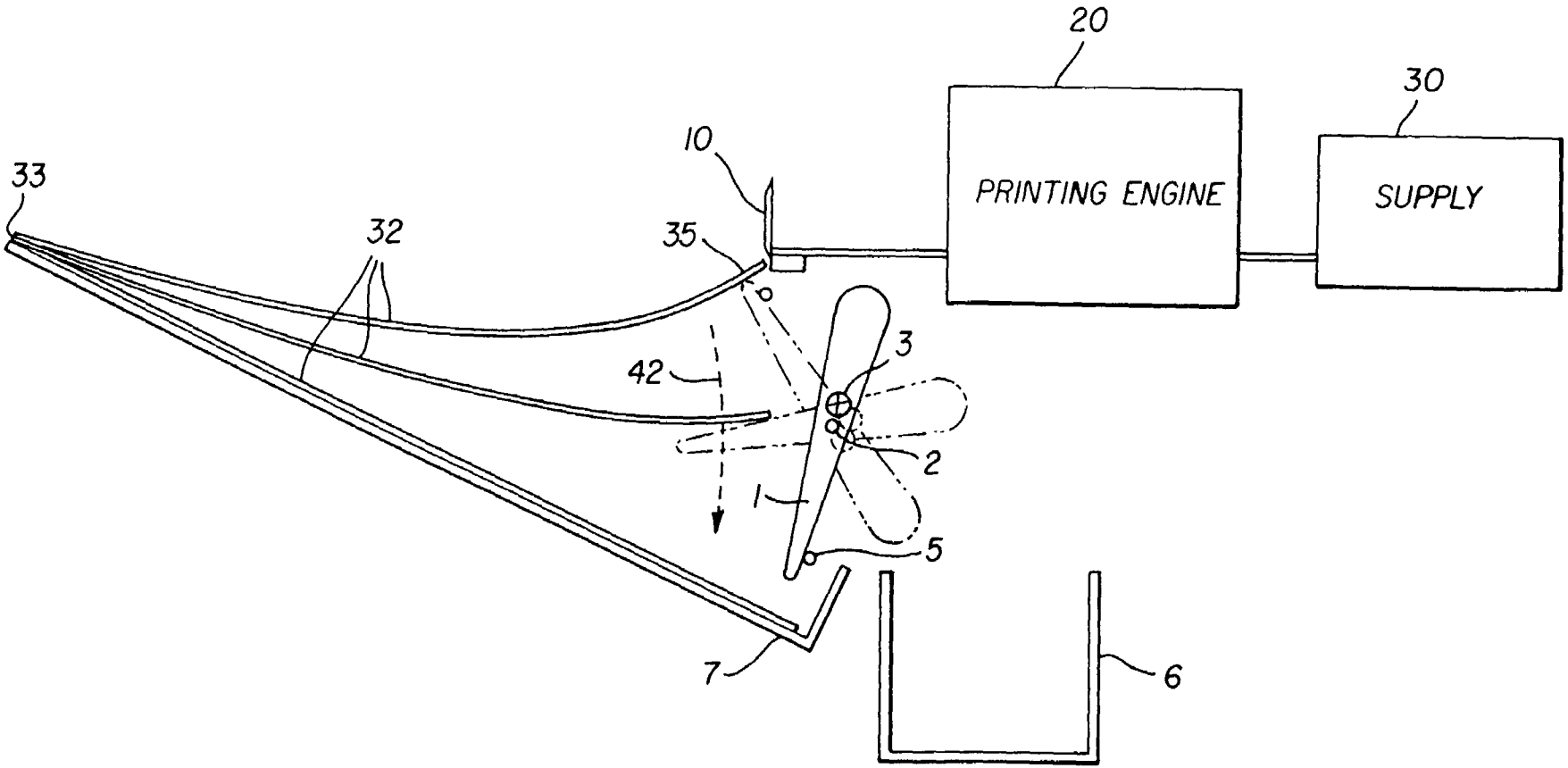
FIG. 2 is a side view elevational schematic of the apparatus of the present invention illustrating the path taken by prints in a preferred embodiment of the present invention.

Referring to FIGS. 1 and 2, there is shown a printing system with a diverter flap 1 biased against an upper stop 4 by gravity. The diverter flap 1 is supported on a pin or axle 2 allowing for pivoting movement of diverter flap 1 about the pivot point created by pin or axle 2. The center of gravity 3 of diverter flap 1 is positioned below pin or axle 2. In this manner, gravity serves to bias diverter flap 1 such that it normally resides in a first position with the upper portion of the diverter flap 2 resting against an upper stop 4. The print paper comes from a supply 30, which may be a roll, or a stack of cut sheets. The paper is sent through a printing engine 20, and arrives at the cutting mechanism 10. The printing engine may be a dye sublimation type thermal printer, an ink jet printer, a laser printer, or an electrophotographic printer. The top of the diverter flap 1 resides just below the plane of the paper as it passes through the cutting mechanism 10, and is positioned downstream from the cutting mechanism 10 such that the gap between the top of the diverter flap 1 and the cutting mechanism 10 is slightly larger than the length of a piece of chad 31. The cutting mechanism 10 may employ a knife-type, a scissor-type cutter, a rotating blade type cutter, or a slitter, all are well known in the art of cutting paper.

FIG. 1 shows a first path 41 that chad 31 takes towards the receptacle 6. Because the piece of chad 31 is not heavy enough to overcome the biasing force on diverter flap 1, the top portion of the diverter flap 1 remains in its normal first position with the top portion of the diverter flap 1 resting against the upper stop 4 as the chad 31 travels along the first path 41.

FIG. 2 shows a second path that the print 32 takes towards the receiving tray 7. The lead end 33 of each print 32 extends past the top of diverter flap 1 when the cutting operation is performed. After the cutting operation is completed, the trailing end 35 of the print 32 falls to contact the top of diverter flap 1. The weight of the print 32 overcomes the biasing force applied to diverter flap 1 thereby causing the diverter flap 1 to pivot down toward the lower stop 5 temporarily resulting in directing the print 32 along a second path 42. In this manner the print 32 is deposited into the receiving tray 7. With the print 32 so deposited into receiving tray 7, gravity will bias the diverter flap 4 to return to its normal first position with the top portion thereof resting against upper stop 4.

Figure 3:
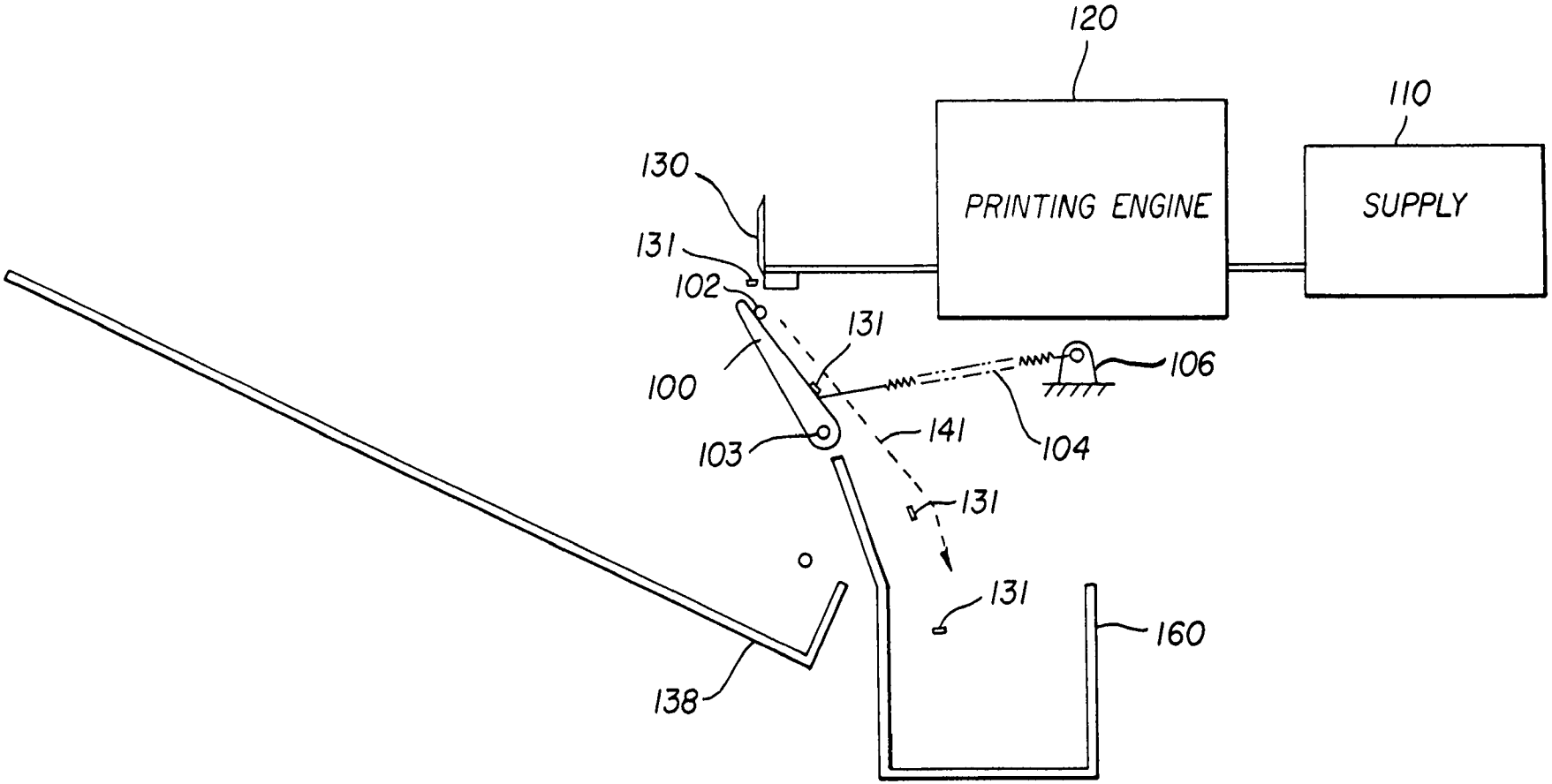
FIG. 3 is a side view elevational schematic of an alternate embodiment of the apparatus depicted in FIGS. 1 and 2 illustrating the path taken by chad in this alternate embodiment.
Figure 4:
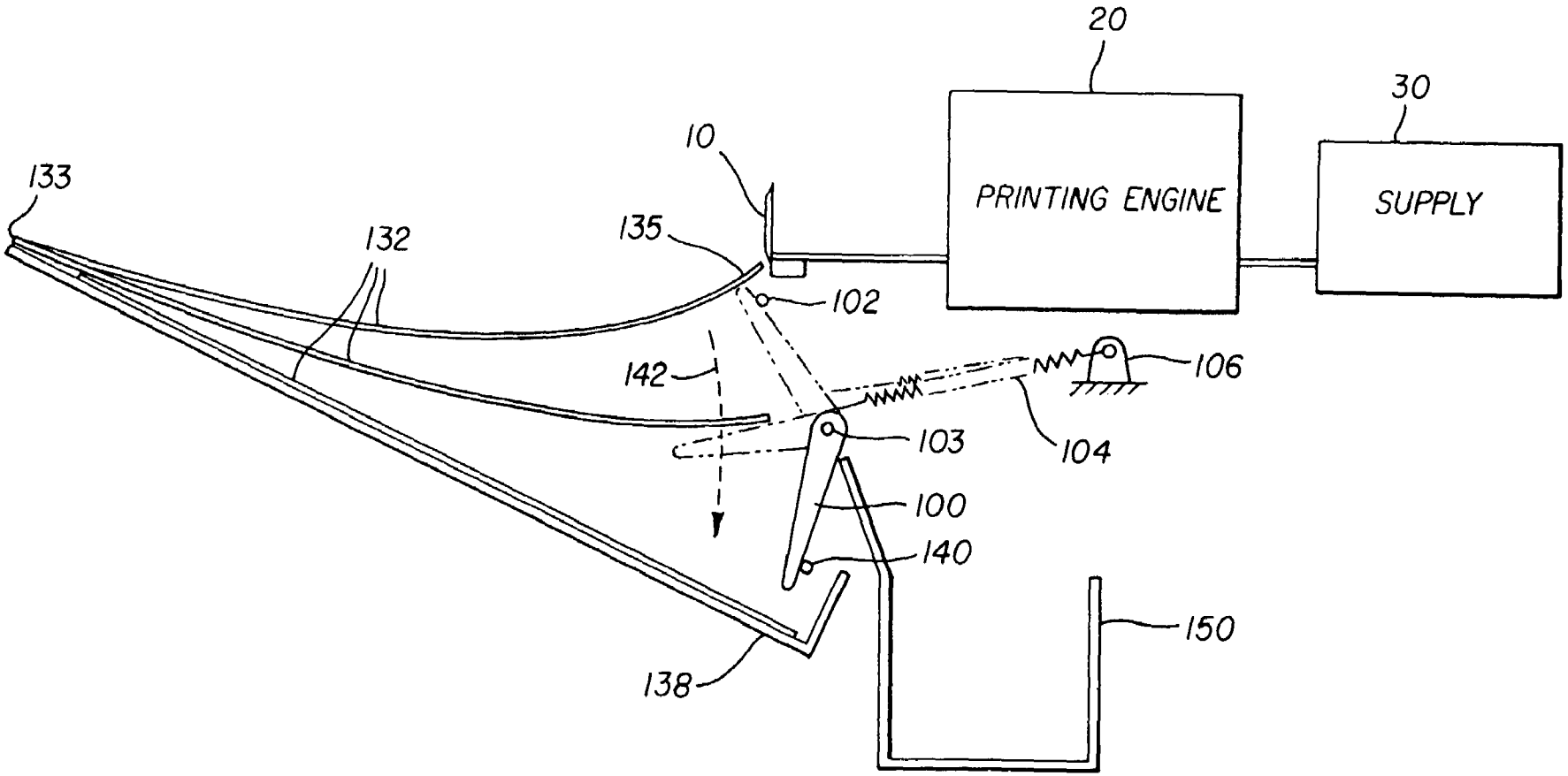
FIG. 4 is a side view elevational schematic of the apparatus of shown in FIG. 3 illustrating the path taken by prints in this alternate embodiment of the present invention.

Referring next to FIGS. 3 and 4, therein is shown a printing system with a diverter flap 100 biased against an upper stop 102. Diverter flap is adapted for pivoting movement about pin or axle 103. A biasing means 104 is used to bias the diverter flap 100 to reside in a normal first position. As shown, the biasing means is a spring residing in tension. The spring is connected at one end thereof to an anchor 106, and at the other end thereof to diverter flap 100 at a point above pin or axle 103. The biasing means 104 depicted is a typical helical spring in tension. However, spring 104 may be of any type, including, for example, a torsion spring or an elastomer tension spring. Further, those skilled in the art will recognize that different types of spring-like biasing means may be employed depending on the position of the anchor with respect to the diverter flap and the connecting or contact point to the diverter flap. For, example, a surface or anchor may be provided on the opposite side of the diverter flap 100 from the anchor 106 shown in FIGS. 3 and 4. Thus, the biasing means 104 may also be a helical spring in compression, a sear spring, or the like. The paper comes from a supply 110, which may be a roll, or a stack of cut sheets. The paper is sent through a printing engine 120, and arrives at the cutting mechanism 130. The top of the diverter flap 100 resides just below the plane of the paper as it passes through the cutting mechanism 130, and is positioned downstream from the cutting mechanism 130 such that the gap between the top of the diverter flap 100 and the cutting mechanism 130 is slightly larger than the length of a piece of chad 131.

FIG. 3 shows a first path that chad 131 takes towards the receptacle 160. Because an individual piece of chad 131 is not heavy enough to overcome the biasing force on diverter flap 100, the top portion of the diverter flap 100 remains in its normal first position with the top portion of the diverter flap 100 resting against the upper stop 102 as the chad 131 travels along the first path 141.

FIG. 4 shows a second path that the print 132 takes towards the receiving tray 138. The lead end 133 of each print 132 extends past the top of diverter flap 100 when the cutting operation is performed. After the cutting operation is completed, the trailing end 135 of the print 132 falls to contact the top of diverter flap 100. The weight of the print 132 overcomes the biasing force applied to diverter flap 100 thereby causing the diverter flap 100 to pivot down toward the lower stop 140 temporarily resulting in directing the print 132 along a second path 142. In this manner the print 132 is deposited into the receiving tray 150. With the print 132 so deposited into receiving tray 150, spring 104 will bias the diverter flap 100 to return to its normal first position with the top portion thereof resting against upper stop 102.

Depending on the printing engine, it will be recognized by those skilled in the art that the paper passing from the print engine may include an unprinted region at the lead end of a print, an unprinted region at the trailing end of the print, or unprinted regions at both the leading and trailing ends of the print. The cutting mechanism can be actuated to cut all of such unprinted regions thereby resulting in pieces of chad.

It can be seen from the detailed description that the present invention delivers cut chad to a receptacle and prints to a receiving tray without the need for sensing the location of the cut chad or print, and without the need for a power actuated diverting mechanism.

Although the present invention has been described with particular reference to illustrative embodiments, the invention is not limited to the details thereof. Various substitutions and modifications will be apparent to those of ordinary skill in the art, and all such substitutions and modifications are intended to fall within the scope of the invention as defined in the appended claims.

PARTS LIST

1 diverter flap
2 pin or axle
3 center of gravity
4 upper stop
5 lower stop
6 receptacle
7 receiving tray
10 cutting mechanism
20 printing engine
30 supply
31 chad
32 print
33 lead end
35 trailing end
41 first path
42 second path
100 diverter flap
102 upper stop
103 pin/axle
104 biasing mean/spring
106 anchor
110 supply
120 printing engine
130 cutting mechanism
131 chad
132 print
133 lead end
135 trailing end
138 receiving tray
140 lower stop
141 first path

142 second path
150 receiving tray
160 receptacle

The invention claimed is:

1. An apparatus comprising:

(a) a cutting mechanism for cutting the paper from the paper printer perpendicular to the path of the paper, said cutting mechanism being adapted to trim paper to produce both a cut sheet and a chad that weighs less than the cut sheet;

(b) a diverter flap positioned downstream of the cutting mechanism;

(c) a biasing member adapted to:

(i) bias the diverter flap to a first position defining a first path for the chad that falls thereon to travel along, the weight of the chad being insufficient to overcome the bias, (ii) allow the diverter flap to be moved to a second position by the weight of the cut sheet falling thereon, thereby allowing the cut sheet to travel along a second path.

2. The apparatus as recited in claim 1 wherein the biasing member is a mass and the diverter flap is biased to reside in the first position by gravity.

3. The apparatus as recited in claim 1 wherein:

the diverter flap is biased to reside in the first position with a spring.

4. The apparatus as recited in claim 1 further comprising:

a print receiving tray adapted to receive the cut sheet traveling along the second path.

5. The apparatus as recited in claim 1 further comprising:

a chad receptacle for receiving chad traveling along the first path.

6. The apparatus as recited in claim 1 wherein:

the diverter flap pivots about a pin.

7. The apparatus as recited in claim 1 wherein:

the diverter flap pivots about an axle.

8. The apparatus as recited in claim 1 further comprising:

a paper supply.

* * * * *